US005695341A

United States Patent [19]

FitzGerald et al.

[11] Patent Number: 5,695,341

[45] Date of Patent: Dec. 9, 1997

[54] SIMULATED AREA WEAPONS EFFECTS DISPLAY ARRANGEMENT

[75] Inventors: Mark Richard FitzGerald, Phoenix; Craig Thomas Griffin, Chandler, both of Ariz.

[73] Assignee: Motorola, Inc., Schaumburg, Ill.

[21] Appl. No.: 654,046

[22] Filed: May 28, 1996

Related U.S. Application Data

[60] Continuation of Ser. No. 445,913, May 22, 1995, abandoned, which is a division of Ser. No. 197,903, Feb. 17, 1994, Pat. No. 5,556,821.

[51] Int. Cl.[6] ..... F16G 1/01

[52] U.S. Cl. ..... 434/16; 434/11; 434/14

[58] Field of Search ..... 434/11, 12, 14–24; 340/903, 901

[56] References Cited

U.S. PATENT DOCUMENTS

| | | | |
|---|---|---|---|
| 4,682,953 | 7/1987 | Doerfel et al. . | |
| 4,729,737 | 3/1988 | Reagan et al. | 434/16 X |
| 4,744,761 | 5/1988 | Doerfel et al. . | |
| 4,955,812 | 9/1990 | Hill | 434/16 |
| 4,976,619 | 12/1990 | Carlson . | |
| 5,228,854 | 7/1993 | Eldridge | 434/14 X |

*Primary Examiner*—Richard J. Apley
*Assistant Examiner*—Glenn E. Richman
*Attorney, Agent, or Firm*—Frank J. Bogacz

[57] ABSTRACT

A method and apparatus controls the display of information for troops and vehicles in a simulated battlefield. Rounds of munition are fired into the simulated battlefield and the effects of such munitions are displayed on the troops and vehicles display devices. These display devices include character displays for troops and display screen for vehicles. The text character display may include such information as damage assessment, weapon type, miss distance and miss direction. A screen display may be used for a vehicle display. The screen display depicts similar information as for the text character display, but in a graphical representation via icons representing various battlefield effects.

6 Claims, 9 Drawing Sheets

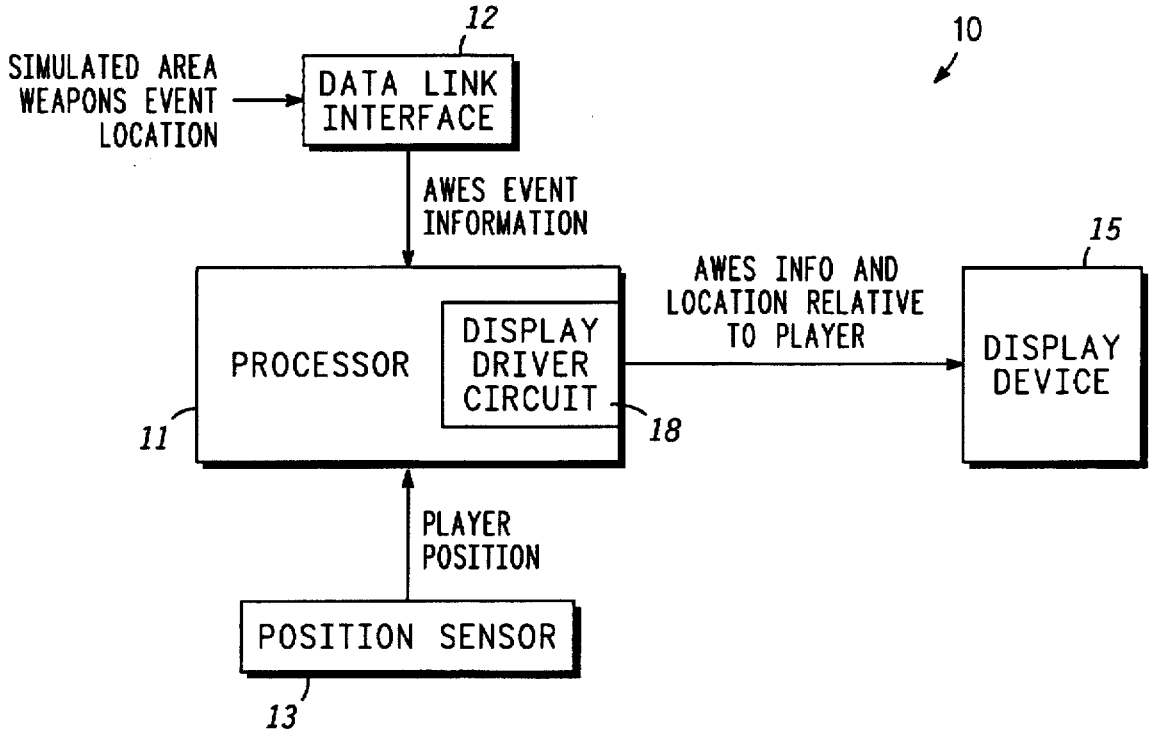
FIG. 1
FIG. 2
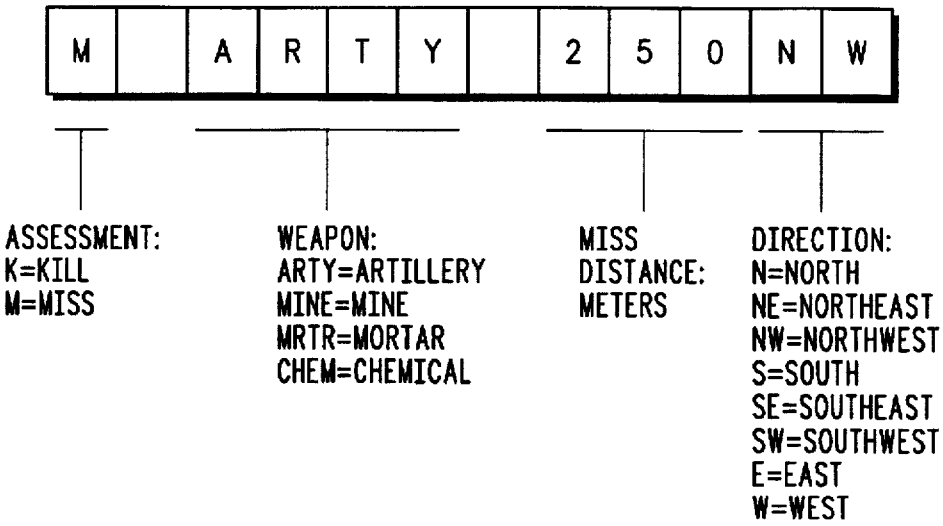

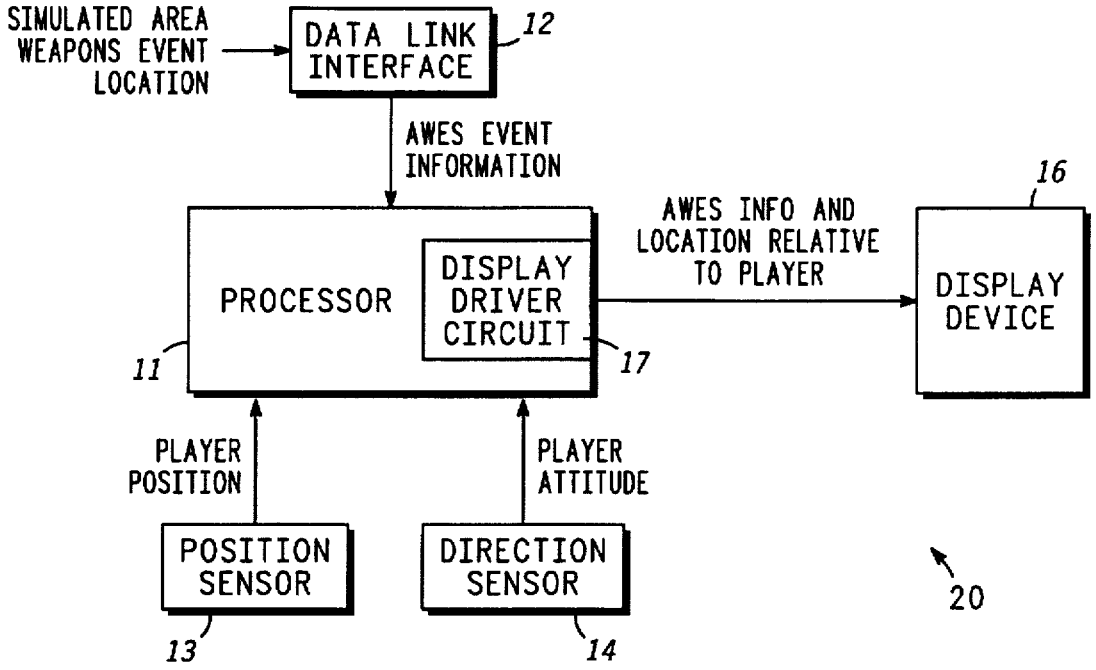
FIG. 3
FIG. 4
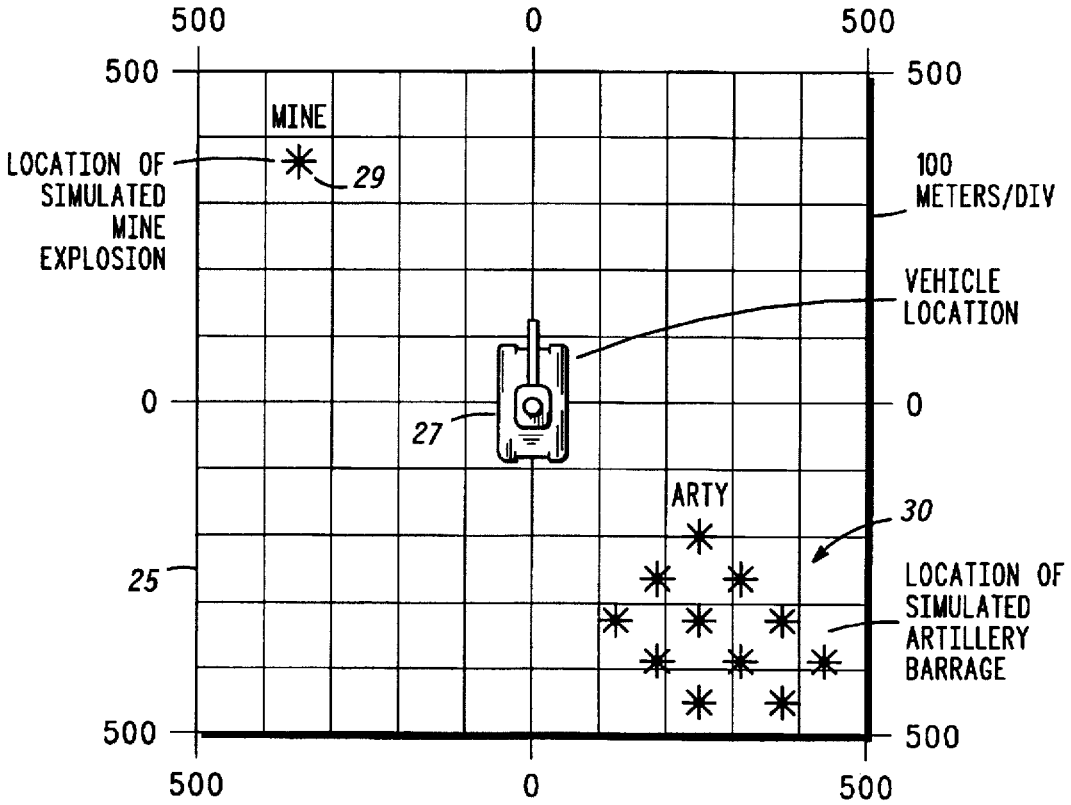

SIMULATED AREA WEAPONS EFFECTS DISPLAY ARRANGEMENT

This application is a continuation of prior application Ser. No. 08/445,913, filed May 22, 1995, abandoned May 28, 1996, which is a division of Ser. No. 08/197,903, filed Feb. 17, 1994, now U.S. Pat. No. 5,556,821.

BACKGROUND OF THE INVENTION

The present invention pertains to simulated area weapons effects systems and more particularly to information display for such systems.

Area Weapons Effects Simulation (AWES) systems are used in military force-on-force exercises to simulate the effects of indirect fire weapons such as artillery, mortars, mines, and chemical weapons. Examples of such systems are the Motorola Combined Arms Training-Integrated Evaluation System (CATIES) and the Simulated Area Weapons Effects-Radio Frequency (SAWE-RF) system by Loral. These systems use a variety of audio/visual cues to indicate to exercise participants in and near the area of effects that they are under fire. The most common cues in use are pyrotechnics, buzzers, injection of sound on the vehicle intercom, and flashing lights. These cues, while effective in notifying the participants that they are being subjected to indirect fire, are inadequate when training soldiers how to survive and to use indirect fire. Specifically, current cueing schemes are deficient when:

First, if no instrumented players with cueing devices are in or close to the area of indirect fire, soldiers outside the area of effects receive absolutely no indication of the fire and are likely to drive into fire. In reality, they would probably have seen the fire and avoided it.

Second, players near the area of effects receive an indication that indirect fire is being employed but are not killed. In this case they must react either by taking cover or moving out of the area. Since no direction information is supplied by any existing cue, the soldiers are likely to drive into the are where the indirect fire is being employed when they are trying to escape it.

Third, Forward Observation Officers (FOO's) cannot redirect mortar or artillery fire when the fire does not land on vehicles instrumented with audio/visual cues that are visible from a distance.

Fourth, pyrotechnic cues are generally the loudest, most visible type of cue and the most realistic. Safety limitations restrict the size and noise of the cue so the effects are much smaller and quieter than real artillery and mortars. In a normal training environment, especially in a desert environment such as the U.S. Army's National Training Center, the dust and noise from the vehicles themselves frequently conceal the signature of the cues.

Typical audio/visual cueing devices used in force-on-force training systems to not provide sufficient information to soldiers and vehicles for proper training in surviving and using indirect fire such as artillery and mortars. In order to increase training realism and teach training forces how to survive and use indirect fire, participants in training exercises need data that is available in a real battle, specifically where the indirect fire is occurring. This is more feedback than any of the existing audio/visual cues are capable of.

BRIEF DESCRIPTION OF THE DRAWINGS

FIG. 1 is a block diagram of a display arrangement for a simulated area weapons effect display system in accordance with the present invention.

FIG. 2 is a layout of an embodiment of display device of FIG. 1, in accordance with the present invention.

FIG. 3 illustrates a block diagram of another embodiment display arrangement for a simulated area weapons effect display system in accordance with the present invention.

FIG. 4 is a layout of a simulated battlefield display device in accordance with the present invention.

DESCRIPTION OF THE PREFERRED EMBODIMENT

Figure 5:
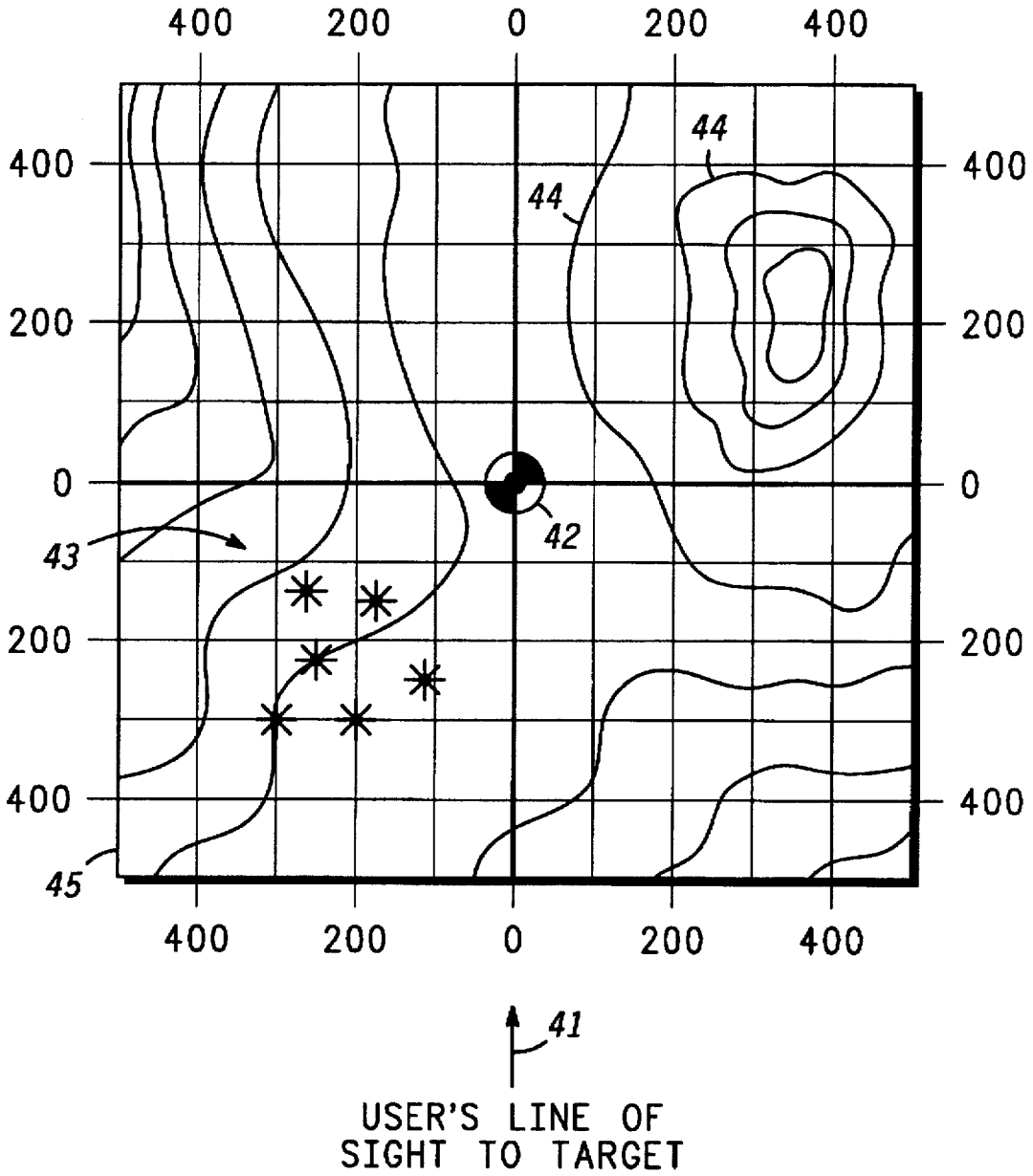
FIG. 5 is a layout of another embodiment of a simulated battlefield display device in accordance with the present invention.

Generally, the present invention provides a display arrangement for a simulated area weapons effects system that informs the soldiers being trained when and where indirect fire is occurring.

The display arrangement for a simulated weapons effects system may be accomplished utilizing the following basic equipment:

A data link to each player to provide information about indirect fire in the area. The data link may be one-way such as the CATIES system or bidirectional.

Position sensors for each player utilizing existing technology such as GPS receivers or multi-lateration receivers.

Processing on each player to process the indirect fire received over the data link, receive the position data from the positioning system, and control the display.

A display to notify each player of the relationship between a reference point and any indirect fire missions occurring in the area. The display may be textual or graphic and show the player distance and direction to the true location of the indirect fire.

The following paragraphs describe typical implementation of the invention for different participants in a normal training exercise, such as dismounted troops, vehicles, Forward Observation Officers (FOO's), and Observer/Controllers (OC's).

FIG. 1 illustrates a block diagram of a display arrangement for a simulated area weapons effect display system 10 in accordance with a preferred embodiment of the invention for dismounted soldiers to notify them of indirect fire in their area. Processor 11 is coupled to data link interface 12, position sensor 13 and to display device 15 via display driver circuit 18.

In this implementation, size and power consumption of the equipment on the player are critical. Simulated area weapons effects display system 10 comprises a data link interface 12, a processor 11, a position sensor 13, display device 15, and display driver circuit 18. The display 15 in this implementation can be a simple 16 character, 1 line alphanumeric display to minimize the overall size of the unit and reduce the power consumption. Data link interface 12, position sensor and display device 15 are coupled to processor 11. The processor 11 receives information received over the data link interface 12 receives from a central source for every indirect fire mission. The data received includes the location of the effects, size of the effects area, and the type of weapon employed (artillery, mortar, mines, or chemical). The implementation is independent of whether casualties are assessed by the processor 11 or at a central site connected to the processor 11 through the data link interface 12 since the purpose of the display is to notify players of indirect fire nearby, not just those that cause a casualty. The data received from the position sensor 13 may be computed position such as that received from a GPS receiver, or data utilized by the processor 11 to compute position. The processor then implements a proximity filter by comparing the player position with the indirect fire position. If the indirect fire is within a predefined threshold, the processor 11 sends a message to the display 15 notifying the player of the location, direction, and type of fire.

This implementation of a simulated area weapons effect display system 10 can be implemented on existing hardware, such as the CATIES Player Detector Device, which has a combined position sensor 13 utilizing multi-lateration technology, a data link interface 12 over the same radio frequency link as the multi-lateration signals, a custom processor board 11 utilizing an Intel 80C31 micro controller, a built-in 16 character, 1 line alphanumeric display 15, and a display driver circuit 18.

FIG. 2 is a layout of an embodiment of display device 15 of FIG. 1, in accordance with the present invention. This display shows sufficient information about the indirect fire to react properly to the fire. Specifically, the player is notified of: whether he was killed or missed, the weapon type, such a mine or chemical weapon, if a miss was detected the direction and miss distance of the indirect fire. In this implementation, direction in increments of 45 degrees and distance in increments of 50 meters are displayed and are sufficient since coarse information is all that is necessary when under actual indirect fire. The type of weapon employed is also displayed since the soldier can normally distinguish the difference in signatures of actual artillery, mortar, mine, and chemical munitions. The remaining information conveys whether the player is still alive or was assessed a simulated kill by the munition.

FIG. 3 illustrates a block diagram of a display arrangement for a simulated area weapons effect display system 20 in accordance with a preferred embodiment of the invention for vehicular players to notify them of indirect fire in their area. Simulated area weapons effects display system 20 comprises processor 11 coupled to a data link interface 12, a position sensor 13, a direction sensor 14, display device 16, and display driver circuit 17. The display device 16 in this implementation may be a small graphics display such as a common 256×256 pixel LCD display. Data link interface 12, position sensor and display device 16 are coupled to processor 11. The processor 11 receives information received over the data link interface 12 which is sent from a central source for every indirect fire mission. The data received includes the location of the effects, size of the effects area, and the type of weapon employed (artillery, mortar, mines, or chemical). As with the dismounted soldier implementation, the implementation is independent of whether casualties are assessed by the processor 11 or at a central site connected to the processor 11 through the data link interface 12. The processor receives position data from the position sensor 13 and vehicle orientation data from the direction sensor 14. Position may be computed position such as that received from a GPS receiver, or data utilized by the processor 11 to compute position. The direction sensor 14 can be an electronic compass or other device which determines direction. The processor implements a proximity filter by comparing the player position with the indirect fire position. If the indirect fire is within a predefined threshold, the processor 11 places a mission icon on the display at the correct location on the display relative to the direction the vehicle is pointing. The weapon type is also displayed.

This implementation of a simulated area weapons effect display system 20 can be implemented by adding graphic display capability and an electronic compass to the CATIES Vehicle Detector Device, which is capable of utilizing GPS or multi-lateration for the positioning sensor has a combined position sensor 13 utilizing multi-lateration technology, a data link interface 12 over the same radio frequency link as the multi-lateration signals, and a commercial processor board 11 utilizing a Motorola 68331 micro controller. The display device 16 can be a simple display screen such as a black and white LCD display; one example is an Optrex 5008INF 320×240 pixel display driven by a SED1330FBA driver circuit 17. Other displays, such as higher resolution color displays by Sharp and Panasonic are also sufficient. Another available platform is certain types of commercial Automatic Vehicle Location (AVL) units being installed in vehicle fleets, specifically those with an integrated map display, GPS receiver, and radio link.

FIG. 4 is a layout of an embodiment of display device 16 of FIG. 1, in accordance with the present invention. FIG. 4 shows a fixed vehicle icon 27 on the display and a grid 25 indicating distances in meters per division from the vehicle 27 with the vehicle 27 at the center of the grid 25. The display of FIG. 4 is designed to display the location from the point of view of the vehicle, with the top of the display being directly in front of the vehicle. Graphical icons showing artillery barrages 30 and individual mine detonations 29 are displayed at the correct location on the display grid 25 relative to the vehicle location and orientation. The impacts 29 and 30 are labeled with the types of weapon (artillery, mortar, mine, and chemical munitions).

FIG. 5 is a layout of an embodiment of display device 16 of FIG. 1, in accordance with the present invention. The data displayed is similar to the vehicle implementation shown in FIG. 4 except that the purpose of the display is to allow a Forward Observation Officer (FOO) to adjust fire. This display shows a fixed target icon 42 on the display and a grid 45 indicating distances from the target 42 at the center of the grid 45. The display is designed to display the location from the point of view of the observer's line of sight 41 to the target. Graphical icons showing simulated fire 43 are displayed at the correct location on the display grid 45 relative to the target 42. In this case, contour lines 44 based on the terrain are included to assist the FOO in adjusting the fire. The FOO implementation may be implemented using the same implementation as the vehicle implementation of the invention although a physical implementation utilizing AVL hardware is more suitable since they are capable of storing map data.

Figure 6:
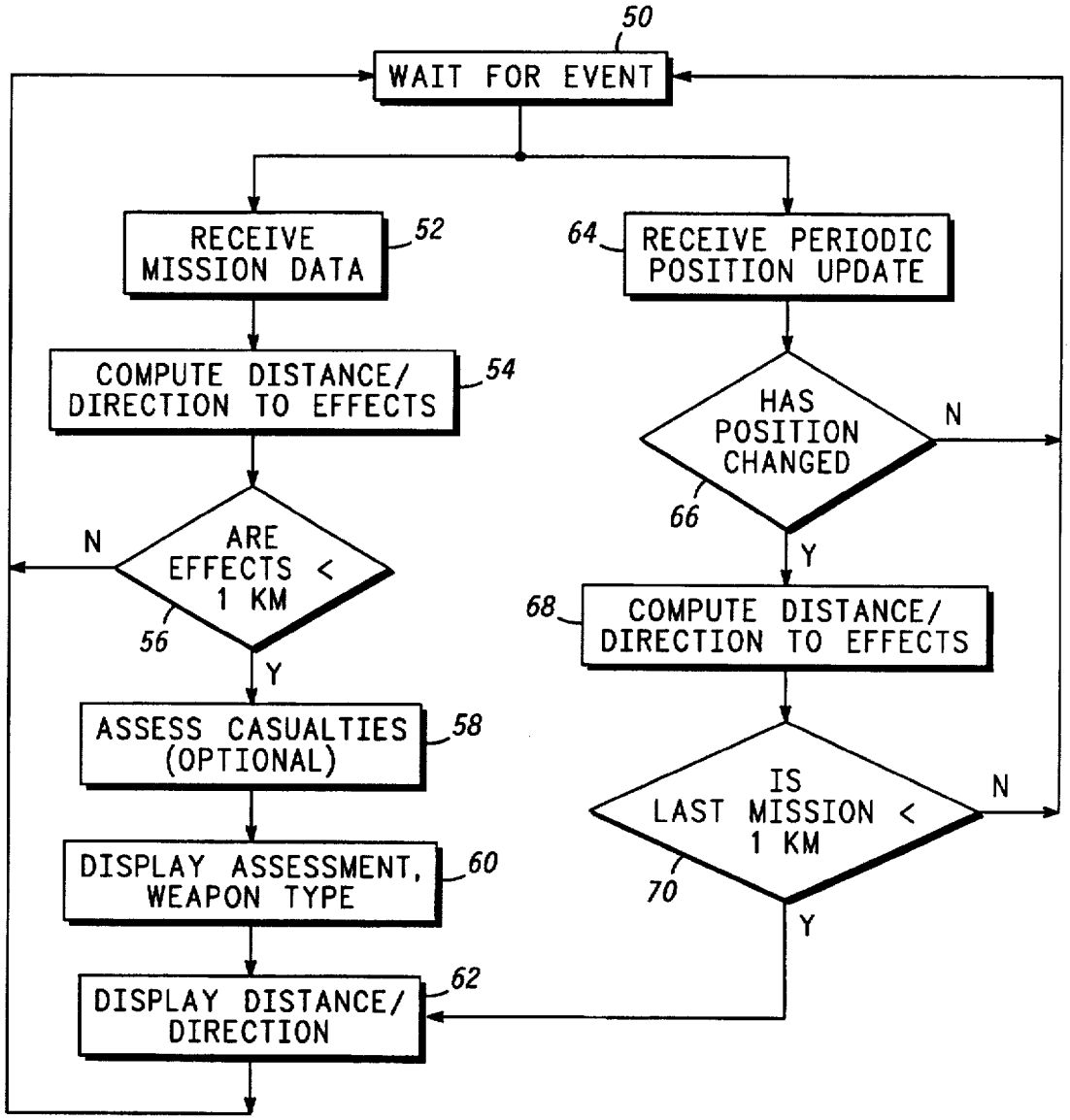
FIG. 6 is a flow chart of the processing for a dismounted troop simulated area weapons effects display system.

Referring to FIGS. 2 and 6 taken in combination, FIG. 6 is a flow chart of the processing for a dismounted troop simulated area weapons effects display system 10. A computer program as shown in FIG. 6 is initiated by the processor 11 every time mission data is received over the data link interface 12 or a position update is received from the position sensor 13. The computer program waits for an event to be initiated, block 50. The initiating events are receiving mission data, block 52 or receiving periodic position updates, block 64. When mission data is received, block 52, the processor 11 computes range and direction from the latest position received from the position sensor 13 to the location of the mission received in the message, block 54. It then computes whether the effects are close enough to display effects (i.e. 1 km.), block 56. If the effects are greater than or equal to the selected distance, block 56 transfers control to block 50 to wait for another triggering event. At this point and if the effects are within the desired distance, in this case <1 km., the processor 11 performs an assessment based on the data if distributed casualty assessment is being used, block 58. The processor 11 then sends the weapon type and assessment (whether received over the data interface 12 or computed) to the display device 15, block 60. The processor 11 then displays the direction and distance data, block 62, computed in an earlier step (block 54).

When position data is received, block 64, from the position sensor 13, the processor 11 determines whether the position has changed, block 66. If the position has not changed, block 66 transfers control to block 50 via the N path to wait for the next event. If so, the direction and distance to the last mission received over the data link interface 12 is recomputed, block 68. If the distance is below a threshold value (e.g. 1 km.) block 70, the processor 11 updates the distance and direction of the effects on the display device 15, block 62. If the change in distance from the last mission is less than 1 km. then block 70 transfers control to block 50 via the N path to wait for the next event.

Figure 7:
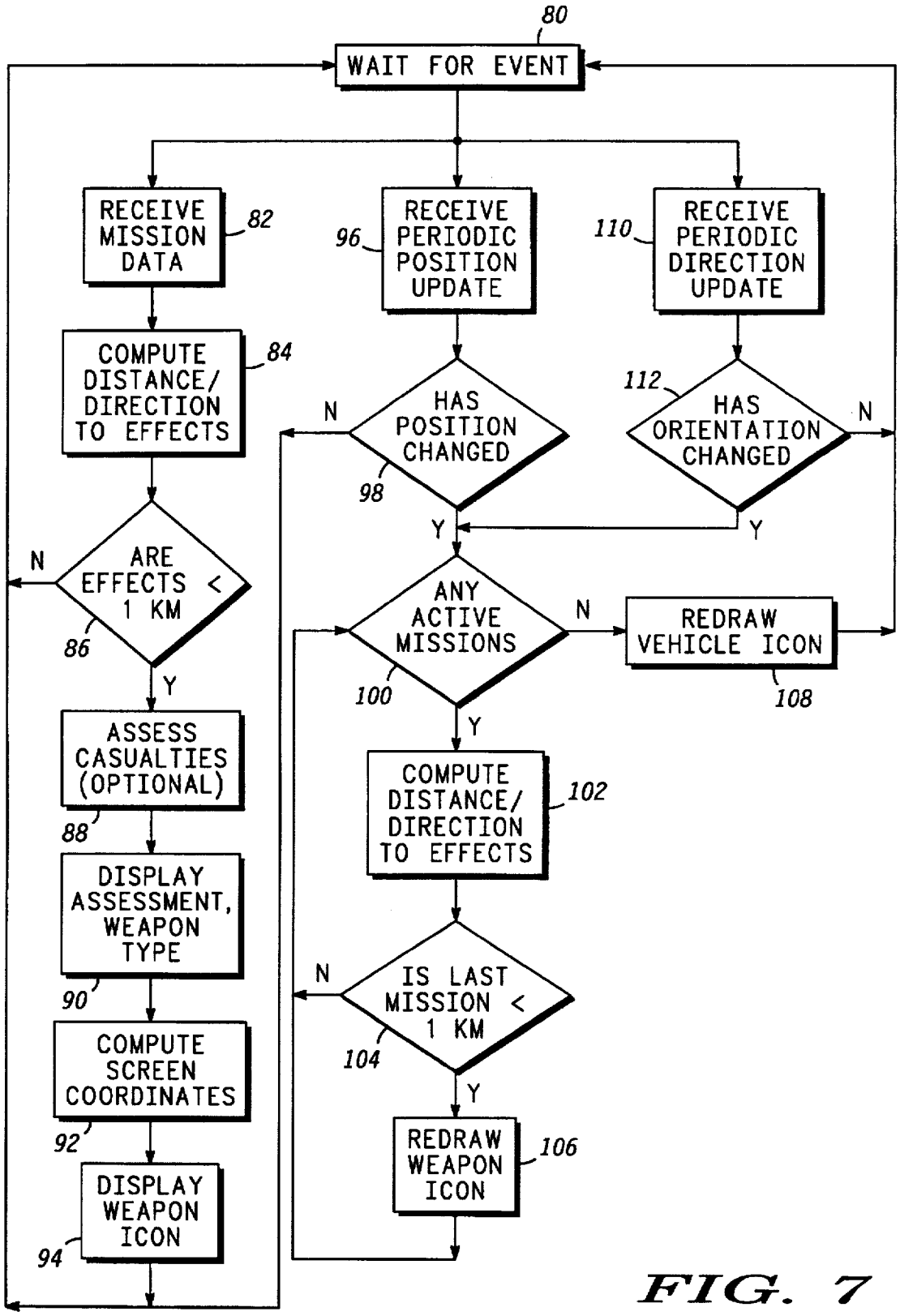
FIG. 7 is a flow chart of the processing for a vehicle of FIG. 4 in simulated area weapons effects display system.

Referring to FIGS. 3, 4 and 7 taken in combination, FIG. 7 is a flow chart of the processing for a vehicle 27 of FIG. 4 in simulated area weapons effects display system 20. A computer program as shown in FIG. 7 is initiated by the processor 11 every time mission data is received over the data link interface 12, position update is received from the position sensor 13, or a direction update is received from the position sensor When mission data is received, block 80 transfer control to block 82, the processor 11 computes range and direction from the latest position received from the position sensor 13 to the location of the mission received in the message, block 84. It then computes whether the effects are close enough to display effects (i.e. 1 km), block 86. If the effects are greater than or equal to the selected distance, block 86 transfers control to block 80 via the N path to wait for another triggering event. At this point and if the effects are within the desired distance, in this case <1 km. the processor 11 performs an assessment based on the data if distributed casualty assessment is being used block 88. The damage assessment and weapon type are displayed, block 90. The processor 11 them computes and converts the coordinates to screen coordinates relative to the latest position and direction, block 92. The processor 11 then displays the weapon icon and type at the correct location on the display device 16 block 94.

When position data is received, block 96, the processor 11 determines whether the unit has moved, block 98. If the position has not changed block 98 transfers control to block 80 via the N path to wait for the next event. If so, block 98 transfers control to block 100. Block 100 determines whether there are any active missions. If there are no active missions block 100 transfer control to block 108 which redraws the vehicle icon in its new location. If there are active missions block 100 transfers control to block 102 via the Y path and block 102 recomputes the direction and distance to the each mission previously received over the data link interface 12. If the distance is below the threshold value (e.g. 1 km.) block 104, the processor 11 translates the coordinates to screen coordinates relative to the vehicle's location and direction and redraws the weapon icon via the display device 16, block 106. When block 100 determines that no other missions are active, it transfers control to block 108 via the N path and the vehicle icon is redrawn at its new location and control is transferred to block 80 to wait for the next event.

When processor 11 receives a periodic direction update, block 110, it transfers control to block 112. Block 112 determines whether the orientation of the vehicle has changed. If not, block 112 transfers control to block 80 via the N path to wait for the next event. If so, block 112 transfers control to block 100 to perform the functions of blocks 100–108 as described above.

Figure 8:
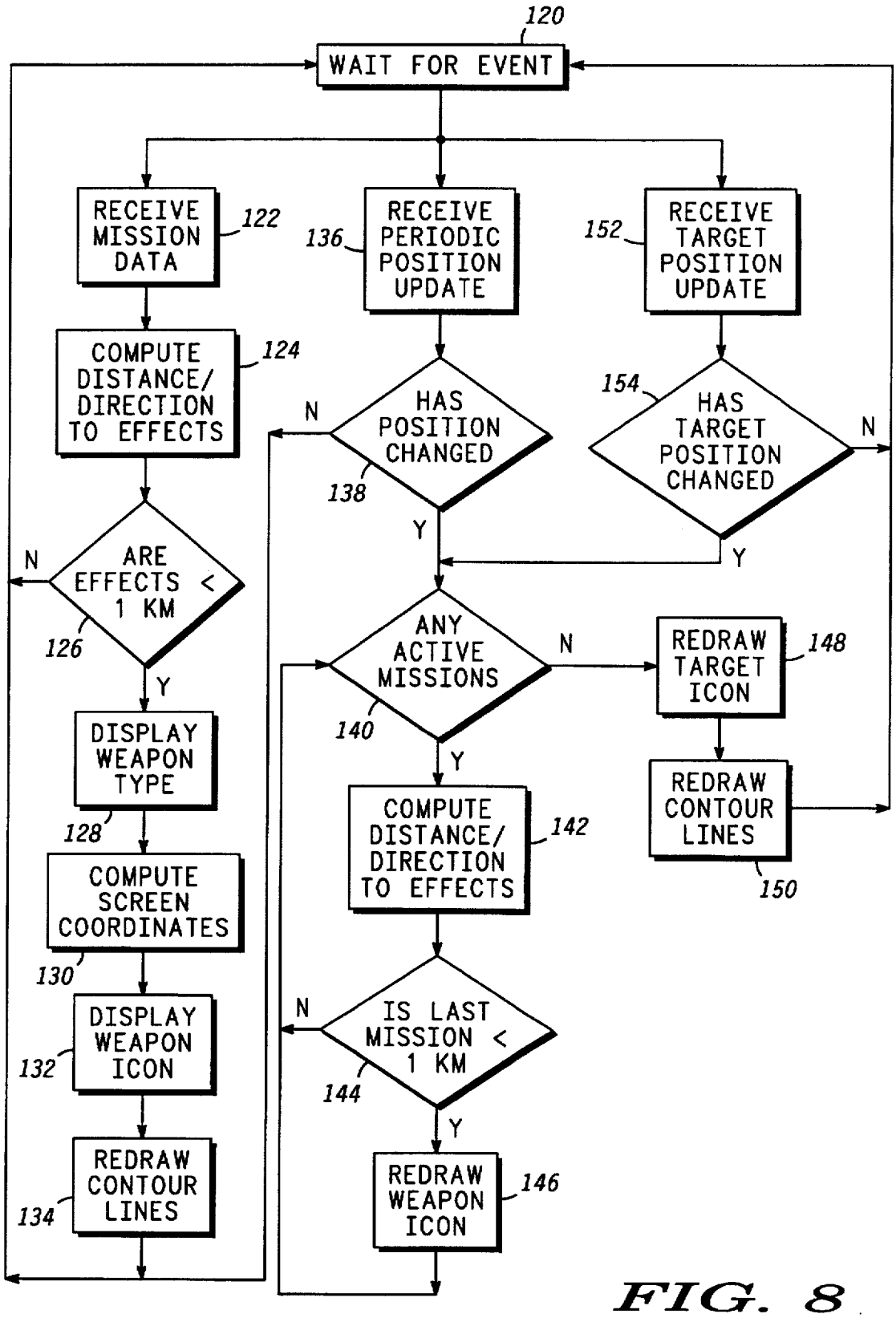
FIG. 8 is a flow chart of the processing for a forward observation officer embodiment in a simulated area weapons effects display system, as shown in FIG. 5.

FIG. 8 is a flow chart of the processing for a forward observation officer simulated area weapons effects display system, as shown in FIG. 5. The computer program shown in FIG. 8 is initiated by the processor 11, block 120 every time mission data is received block 122 over the data link interface 12, position update is received from the position sensor 13. When mission data is received block 122, the processor 11 computes range and direction from the latest target position to the location of the mission received in the message, block 124. It then computes whether the effects are close enough to display effects (e.g. 1 km), block 126. If the effects are greater than or equal to 1 km., block 126 transfers control via the N path to block 120 to wait for the next event. If the effects are less than the 1 km. distance, block 128 displays the weapon type. The processor 11 them computes and converts the coordinates to screen coordinates relative to the target location and along the FOO to the target line 41, block 130. The processor 11 then displays the weapon icon and type at the correct location on the display device 16, block 132. The processor 11 then redraws the contour lines, block 134.

When position data is received, block 136, the processor 11 determines whether the unit has moved, block 138. If the position has not changed block 138 transfers control via the N path to block 120 to wait for the next event. If so, block 138 transfers control to block 140 via the Y path. Block 140 determines whether there are any active missions. If there are no active missions block 140 transfer control to block 148 which redraws the target icon in its new location. Block 150 then redraws the contour lines and transfers control to block 120 to wait for the next event. If there are active missions block 140 transfers control to block 142 via the Y path and block 142 computes the direction and distance to the effects. If the distance is below the threshold value (e.g. 1 km.) block 144, the processor 11 translates the coordinates to screen coordinates relative to the vehicle's location and direction and redraws the weapon icon, block 146. When block 140 determines that no other missions are active, it transfers control to block 148 via the N path and the target icon is redrawn at its new location; block 150 then redraws the contour lines and control is transferred to block 120 to wait for the next event.

When processor 11 receives a periodic target position update, block 152, it transfers control to block 154. Block 154 determines whether the target position has changed. If not, block 154 transfers control to block 120 via the N path to wait for the next event. If so, block 154 transfers control to block 140 to perform the functions of blocks 140–150 as described above.

Figure 9:
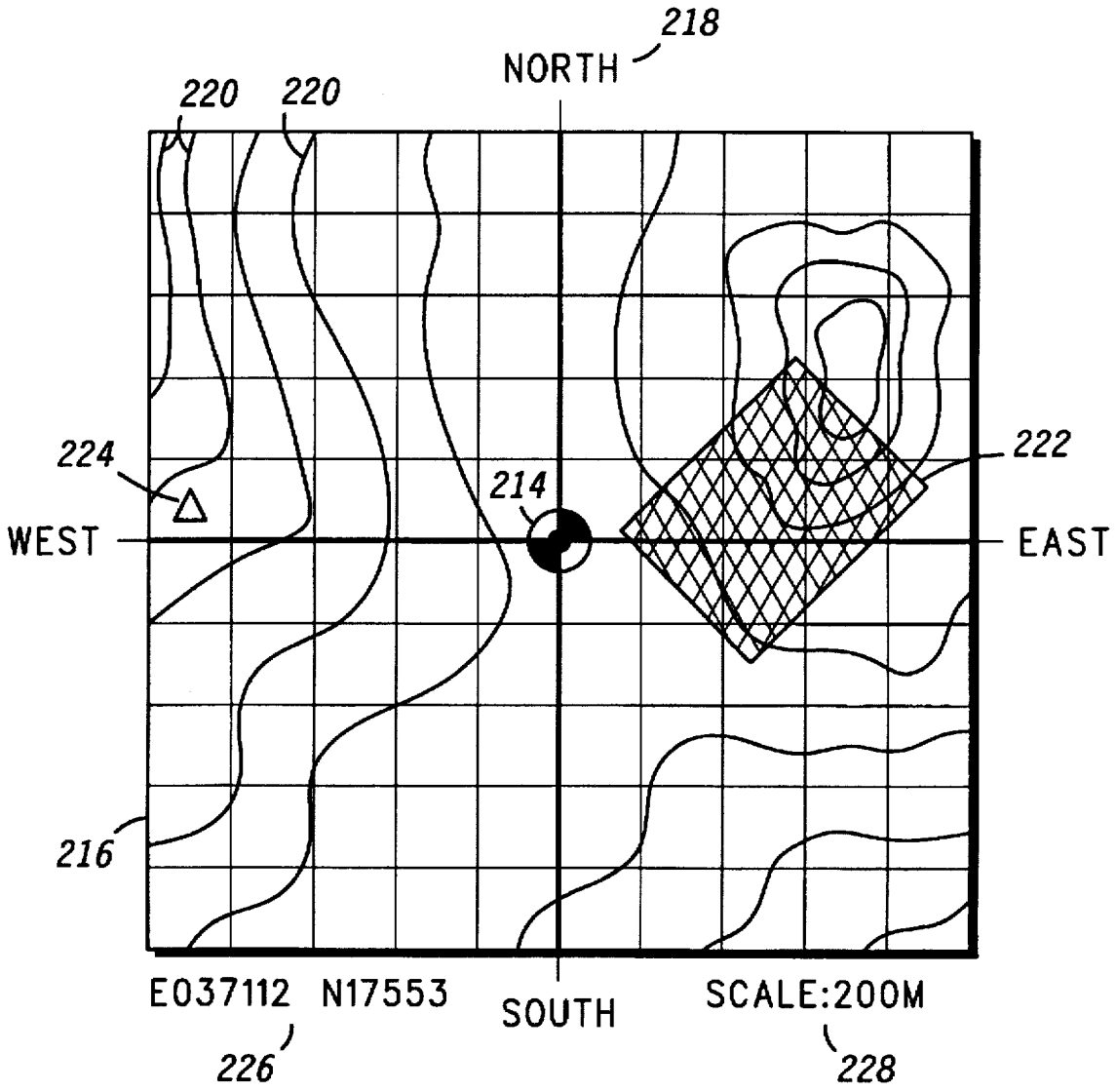
FIG. 9 is a layout of another embodiment of simulated battlefield display device in accordance with the present invention.

FIG. 9 is a layout of an embodiment of display device 16 of FIG. 1, in accordance with the present invention. The data displayed is similar to the Forward Observation Officer implementation shown in FIG. 5 except that the purpose of the display is to allow a Field Controller (FC), or umpire, in a training exercise to determine the location of indirect fire with respect to himself and other players for which they are acting as an umpire,.Forward Observation Officer (FOO), to adjust fire. This display shows a fixed user position icon 214 on the display and a map grid 216. The top of the display 218 is always north and terrain contour lines 220 are shown to allow the umpire to correlate display data with a paper map. Graphical icons showing simulated fire 222 and players requested by the 224 are displayed at the correct location on the map. To further assist the FC, the current position 226 and map scale 228 are displayed. The FC implementation may be implemented using the same implementation as the vehicle implementation, although a physical implementation utilizing AVL hardware is more suitable since they are capable of storing map data.

Figure 10:
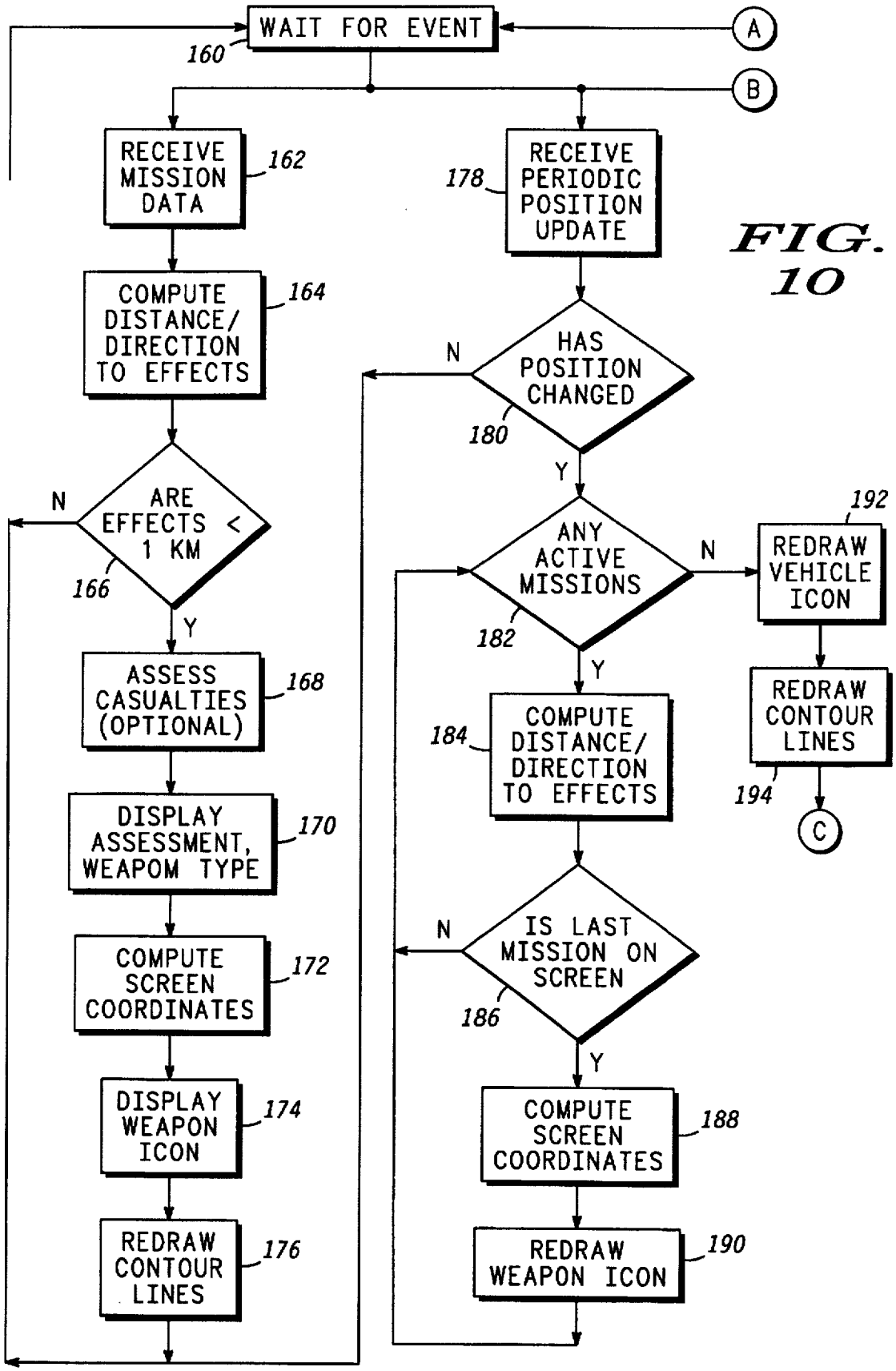
FIG. 10 is a flow chart of the processing for a Field Controller of FIG. 9 in a simulated area weapons effects display system.
Figure 11:
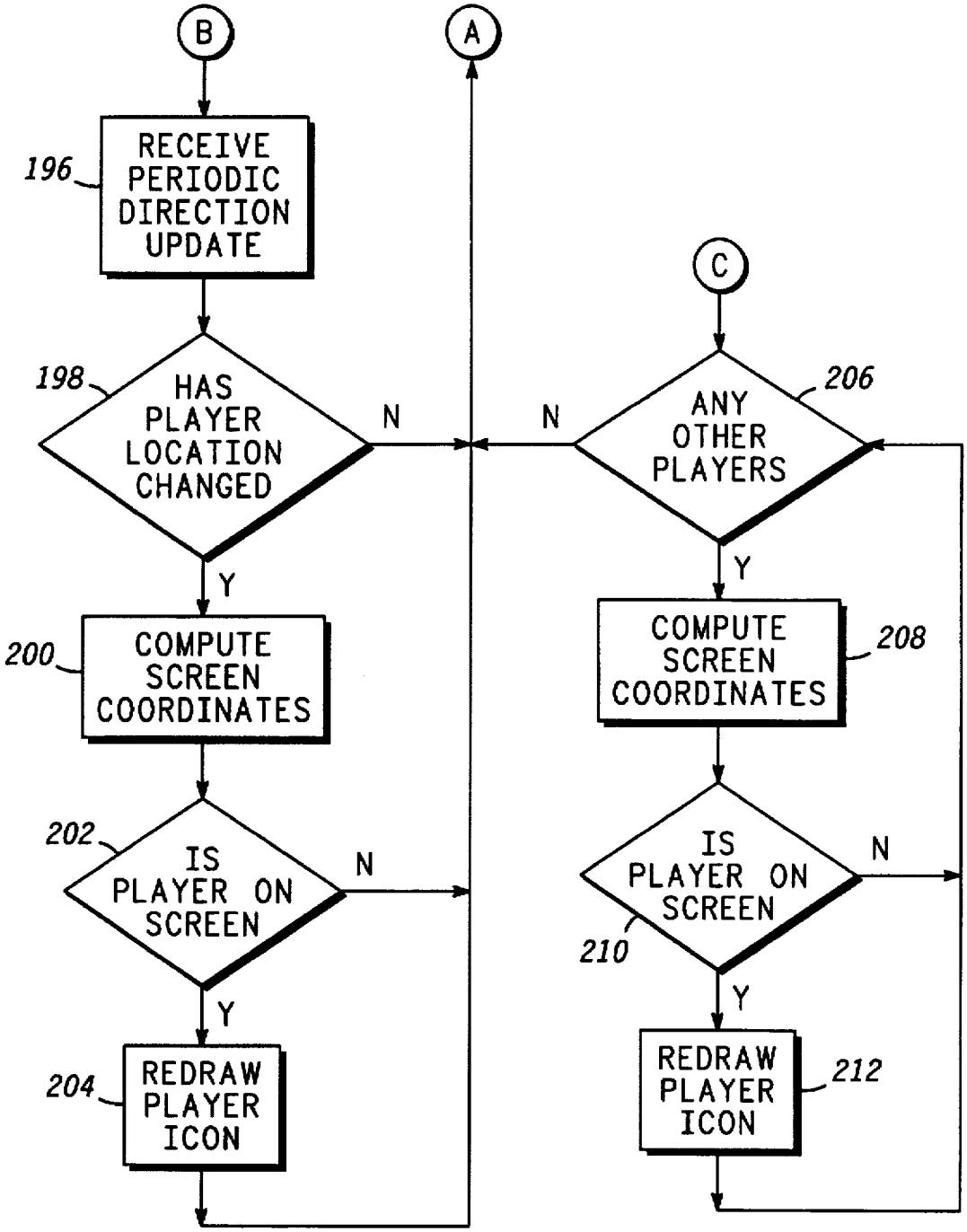
FIG. 11 is a flow chart of the processing for a Field Controller.

FIGS. 10 and 11 is a flow chart of the processing for a Field Controller simulated area weapons effects display system. The computer program shown in FIG. 10 is initiated by the processor 11 every time mission data is received over the data link interface 12, position update is received from the position sensor 13, or a position update is received over the data link interface 12 for a player being monitored, block 160 When mission data is received, block 162, the processor 11 determines if it is within the range of the map, with the latest location of the FC being the map center, block 164. Processor 11 computes range and direction from the latest position to the effects of the mission received in the message, block 164. It then computes whether the effects are close enough to display effects (e.g. 1 km), block 166. If the effects are greater than or equal to 1 km., block 166 transfers control via the N path to block 160 to wait for the next event. If the effects are less than the 1 km. distance, block 168 assesses the casualties as killed or missed (optional) and block 170 displays the damage assessment and weapon type. The processor 11 them computes and converts the coordinates to screen coordinates relative to the umpire's location, block 172. The processor 11 then displays the weapon icon and type at the correct location on the display device 16, block 174. The processor 11 then redraws the contour lines, block 176.

When position data is received, block 178, the processor 11 determines whether the unit has moved or changed direction, block 180. If the position has not changed block 180 transfers control to block 160 via the N path to wait for the next event. If the position has changed, block 180 transfers control to block 182 via the Y path. Block 182 determines whether there are any active missions. If there are no active missions block 182 transfer control to block 192 which redraws the vehicle icon in its new location. Block 194 then redraws the contour lines and transfers control to block 206. If there are active missions block 182 transfers control to block 184 via the Y path and block 184 computes the direction and distance to the effects. If the last mission is not on the display screen, block 186, transfers control to block 182 to check for other active missions. I the last mission is on the display screen, block 186 transfers control to block 188 to translate the coordinates to screen coordinates relative to the vehicle's location and direction. Block 190 then redraws the weapon icon. Then control is transferred to block 182 to check for other active missions.

When processor 11 receives a periodic direction update, block 196, it transfers control to block 198. Block 198 determines whether the target position has changed. If not, block 198 transfers control to block 140 via the N path to wait for the next event. If so, block 198 transfers control to block 200 to compute display screen coordinates for a particular player to be shown on the display screen. Next block 202 determines whether the player is presently displayed on the display screen. If not, block 202 transfers control to block 160 to wait for the next event. If so, block 204 redraws the player on the screen and transfer control to block 160.

Block 206 determines whether any other players are being monitored by the umpire or FC. if not, block 206 transfers control to block 160. Next block 208 computes the screen coordinates of the player to be monitored. Block 210 determines whether the player is on the display screen. If not, block 210 transfer control to block 206 to check for other players. If so, block 210 transfers control to block 212 which redraws the player on the screen and transfers control to block 206.

In summary, this invention provides display feedback to exercise participants that does not currently exist in force-on-force training systems, specifically those simulating area weapons effects. The display of distance, direction, and weapon data to the exercise participants provides information that is readily available to the soldiers in a real battle but is not presented by any existing simulated area weapons effects cue. Currently, players in training exercises utilizing existing cues, including pyrotechnics, can receive negative training and may make decisions that would be lethal in real battle. This defeats the purpose of training the soldiers how to react to area weapons. Equally important, this invention does not introduce additional data that the player could use in a training scenarios but not in real battle, such as exact distance and direction of every round or locations of other players. Implementation of this invention would enhance the ability of existing area weapons simulation systems to provide positive training by providing data not currently provided by existing devices.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. In a simulated area weapons effective system, a display arrangement for providing information to troops and vehicles relative to simulated rounds of munition, said arrangement comprising:

a processor:

a position sensor for providing a position of a troop or a vehicle to said processor, said position sensor coupled to said processor;

a data link for providing information of said simulated round of munition to said processor, said data link coupled to said processor; and a display device for providing a graphical representation of a target vicinity including a plurality of said simulated rounds of munition within a predefined proximity of said display device from an observer's line-of-sight, said target vicinity including further including a type of simulated round of munition fired and a range and a direction from reference point relative to a location of said simulated round of munition and contour lines, said display device coupled to said processor.

2. In a simulated area weapons effective system, a display arrangement as claimed in claim 1, wherein there is further included a display driver circuit for controlling said display device, said display driver circuit coupled to said processor.

3. In a simulated area weapons effective system, a display arrangement as claimed in claim 1, wherein there is further included a direction sensor for providing a direction of said vehicle to said processor, said direction sensor coupled to said processor.

4. In a simulated area weapons effective system, a display arrangement as claimed in claim 1, wherein said display device includes a character text information display for displaying a damage assessment, a weapon type, a miss distance and a miss direction.

5. In a simulated area weapons effective system, a display arrangement as claimed in claim 1, wherein said display device includes a display screen for visually showing said vehicle or said troop, a distance grid and a simulated weapon type.

6. In a simulated area weapons effective system, a display arrangement as claimed in claim 1, wherein said display device includes a display screen for visually showing compass directions, a map scale, said user's position coordinated and said weapon type.

* * * * *